US006132054A

United States Patent [19]

Rogers et al.

[11] Patent Number: 6,132,054

[45] Date of Patent: Oct. 17, 2000

[54] MEMORIAL LIGHT ASSEMBLY

[76] Inventors: Anthony D. Rogers; Kimberly N. Rogers, both of 100 Crooked La., Pickens, S.C. 29671

[21] Appl. No.: 09/150,610

[22] Filed: Sep. 10, 1998

[51] Int. Cl.[7] ..... F21S 8/00; F21V 33/00

[52] U.S. Cl. ..... 362/86; 362/145; 362/183; 362/234; 362/253; 362/392; 362/810; 52/103

[58] Field of Search ..... 362/121, 134, 362/145, 183, 184, 234, 253, 392, 810, 86, 192; 52/103, 104; 40/124.5

[56] References Cited

U.S. PATENT DOCUMENTS

| | | | |
|---|---|---|---|
| 3,684,882 | 8/1972 | Mininno et al. | 362/184 |
| 4,304,076 | 12/1981 | Splendora | 52/104 |
| 5,124,903 | 6/1992 | Coviello | 362/392 |
| 5,255,170 | 10/1993 | Plamp et al. | 362/183 |
| 5,517,791 | 5/1996 | Weiss | 52/103 |
| 5,564,816 | 10/1996 | Arcadia et al. | 362/183 |
| 5,582,478 | 12/1996 | Ambrosino | 362/234 |
| 5,729,921 | 3/1998 | Rojas | 40/124.5 |

*Primary Examiner*—Alan Cariaso

[57] ABSTRACT

A memorial light assembly for providing a pair of light sources configured to resemble a pair of candles for mounting to the top of a headstone. The memorial light assembly includes a base adapted for mounting on a headstone. A pair of candle assemblies are upwardly extended from the base. Each of the candle assemblies has a light source with an outer configuration designed to simulate a flame of a candle. A power source assembly is mounted to the base and is electrically connected to the light sources.

14 Claims, 3 Drawing Sheets

MEMORIAL LIGHT ASSEMBLY

BACKGROUND OF THE INVENTION

1. Field of the Invention

The present invention relates to headstone accessories and more particularly pertains to a new memorial light assembly for providing a pair of light sources configured to resemble a pair of candles for mounting to the top of a headstone.

2. Description of the Prior Art

The use of headstone accessories is known in the prior art. More specifically, headstone accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 5,404,343; U.S. Pat. No. 5,564,816; U.S. Pat. No. 4,169,970; U.S. Pat. No. 4,516,835; U.S. Pat. No. 1,650,630; and U.S. Pat. No. Des. 381,182.

While these devices fulfill their respective, particular objectives and requirements, the aforementioned patents do not disclose a new memorial light assembly. The inventive device includes a base adapted for mounting on a headstone. A pair of candle assemblies are upwardly extended from the base. Each of the candle assemblies has a light source with an outer configuration designed to simulate a flame of a candle. A power source assembly is mounted to the base and is electrically connected to the light sources.

In these respects, the memorial light assembly according to the present invention substantially departs from the conventional concepts and designs of the prior art, and in so doing provides an apparatus primarily developed for the purpose of providing a pair of light sources configured to resemble a pair of candles for mounting to the top of a headstone.

SUMMARY OF THE INVENTION

In view of the foregoing disadvantages inherent in the known types of headstone accessories now present in the prior art, the present invention provides a new memorial light assembly construction wherein the same can be utilized for providing a pair of light sources configured to resemble a pair of candles for mounting to the top of a headstone.

The general purpose of the present invention, which will be described subsequently in greater detail, is to provide a new memorial light assembly apparatus and method which has many of the advantages of the headstone accessories mentioned heretofore and many novel features that result in a new memorial light assembly which is not anticipated, rendered obvious, suggested, or even implied by any of the prior art headstone accessories, either alone or in any combination thereof.

To attain this, the present invention generally comprises a base adapted for mounting on a headstone. A pair of candle assemblies are upwardly extended from the base. Each of the candle assemblies has a light source with an outer configuration designed to simulate a flame of a candle. A power source assembly is mounted to the base and is electrically connected to the light sources.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new memorial light assembly apparatus and method which has many of the advantages of the headstone accessories mentioned heretofore and many novel features that result in a new memorial light assembly which is not anticipated, rendered obvious, suggested, or even implied by any of the prior art headstone accessories, either alone or in any combination thereof.

It is another object of the present invention to provide a new memorial light assembly which may be easily and efficiently manufactured and marketed.

It is a further object of the present invention to provide a new memorial light assembly which is of a durable and reliable construction.

An even further object of the present invention is to provide a new memorial light assembly which is susceptible of a low cost of manufacture with regard to both materials and labor, and which accordingly is then susceptible of low prices of sale to the consuming public, thereby making such memorial light assembly economically available to the buying public.

Still yet another object of the present invention is to provide a new memorial light assembly which provides in the apparatuses and methods of the prior art some of the advantages thereof, while simultaneously overcoming some of the disadvantages normally associated therewith.

Still another object of the present invention is to provide a new memorial light assembly for providing a pair of light sources configured to resemble a pair of candles for mounting to the top of a headstone.

Yet another object of the present invention is to provide a new memorial light assembly which includes a base adapted for mounting on a headstone. A pair of candle assemblies are upwardly extended from the base. Each of the candle assemblies has a light source with an outer configuration designed to simulate a flame of a candle. A power source assembly is mounted to the base and is electrically connected to the light sources.

Still yet another object of the present invention is to provide a new memorial light assembly that that may be mounted to a preexisting headstone or made integral with a headstone.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
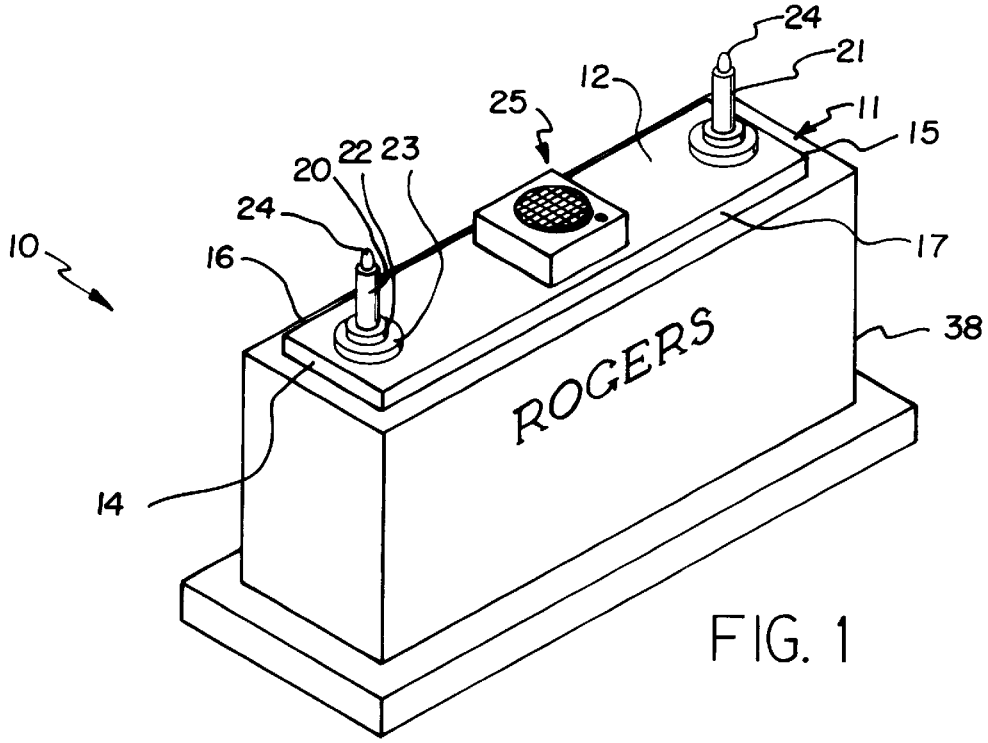
FIG. 1 is a schematic perspective view of a new memorial light assembly according to the present invention.
Figure 2:
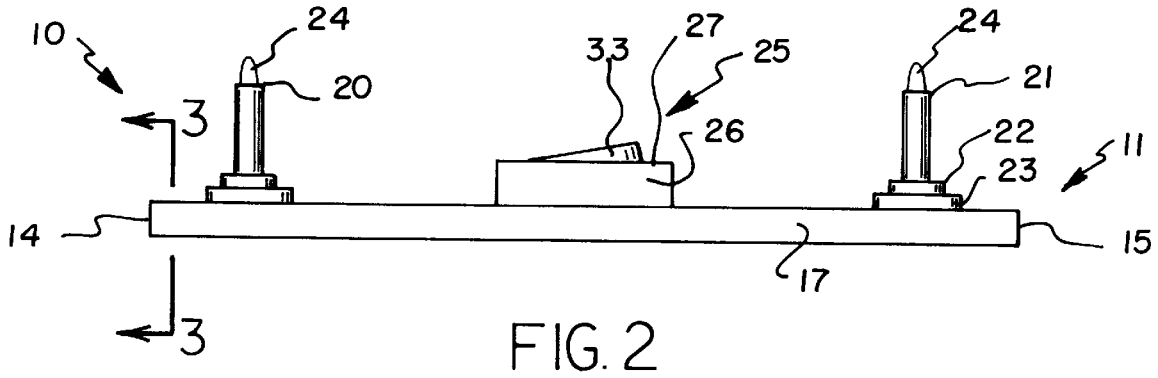
FIG. 2 is a schematic side view of the present invention.
Figure 3:
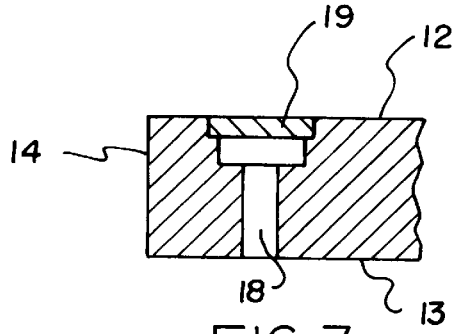
FIG. 3 is a schematic cross sectional view of the present invention taken from line 3—3 of FIG. 2.
Figure 4:
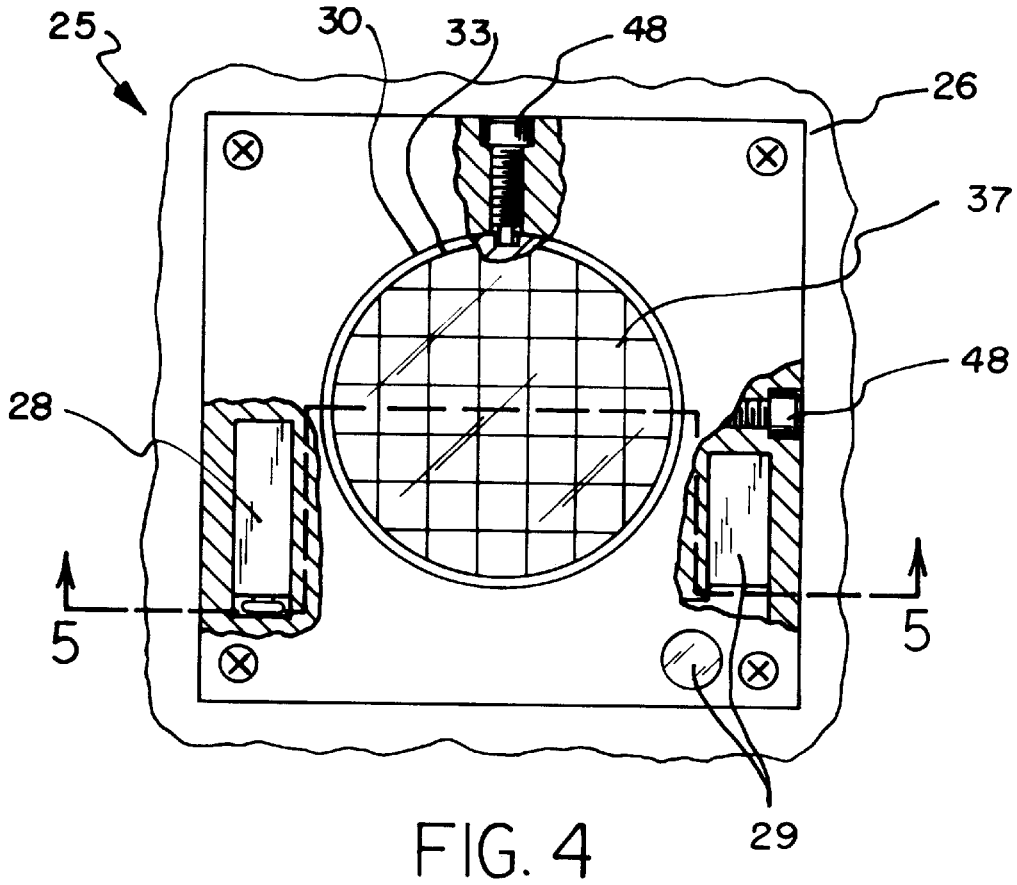
FIG. 4 is a schematic top view of the housing of the power source assembly of the present invention.
Figure 5:
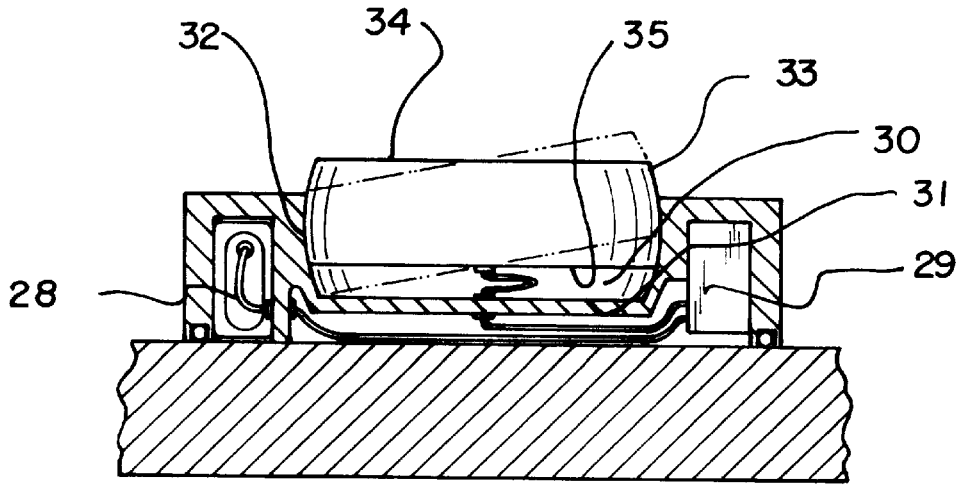
FIG. 5 is a schematic cross sectional view of the present invention taken along line 5—5 of FIG. 4.
Figure 6:
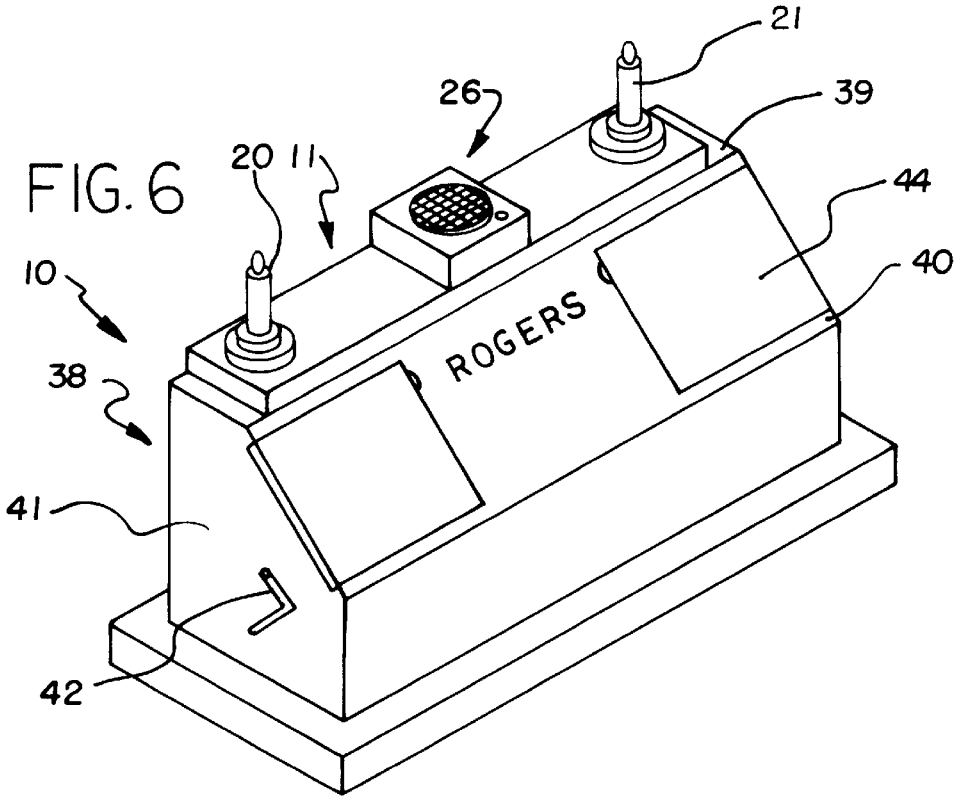
FIG. 6 is a schematic perspective view of an embodiment of the present invention integral with a headstone and having a video image playing device.
Figure 7:
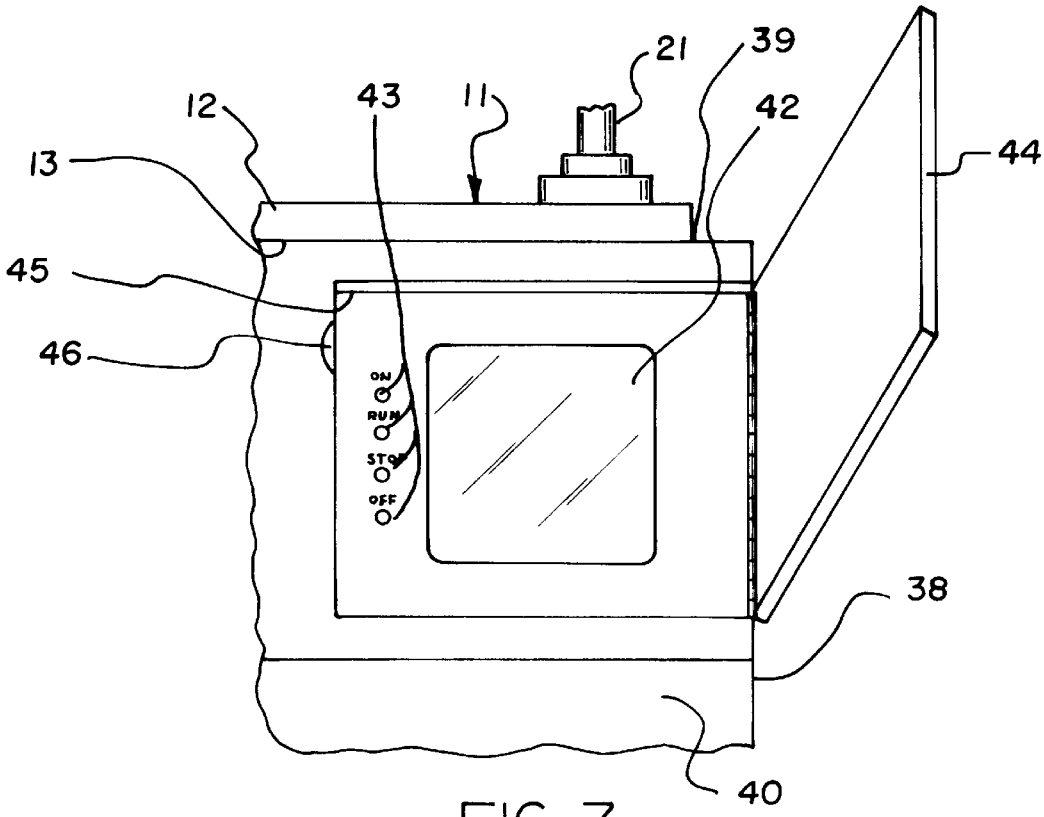
FIG. 7 is a schematic side view a video display monitor of the embodiment of the present invention of FIG. 6.

With reference now to the drawings, and in particular to FIGS. 1 through 7 thereof, a new memorial light assembly embodying the principles and concepts of the present invention and generally designated by the reference numeral 10 will be described.

As best illustrated in FIGS. 1 through 7, the memorial light assembly 10 generally comprises a base 11 adapted for mounting on a headstone 38. A pair of candle assemblies 20,21 are upwardly extended from the base 11. Each of the candle assemblies 20,21 has a light source 24 with an outer configuration designed to simulate a flame of a candle. A power source assembly 25 is mounted to the base 11 and is electrically connected to the light sources 24.

In closer detail, the base 11 is generally rectangular in configuration and has generally planar top and bottom faces 12,13, a pair of generally straight end edges 14,15, and a pair of generally straight side edges 16,17 extending between the end edges 14,15 of the base 11. The base 11 preferably comprises a plastic material and has an outer configuration designed to resemble the texture and color of the headstone 38 it is to be mounted on. The top and bottom faces 12,13 of the base 11 preferably lie in generally parallel planes to one another. Preferably, the end edges 14,15 of the base 11 extend generally parallel to one another and the side edges 16,17 of the base 11 extend generally parallel to one another and generally perpendicular to the end edges 14,15. The end edges 14,15 and the side edges 16,17 of the base 11 preferably lie in generally perpendicular planes to the top and bottom faces 12,13 of the base 11.

The base 11 is designed for mounting on top of a headstone 38. The base 11 has a plurality of countersunk bores 18 extending therethrough between the top and bottom faces 12,13 of the base 11. The bores 18 are preferably located adjacent each of the corners of the base 11. The bores 18 are designed for extending fasteners therethrough to fasten the base 11 to a headstone 38. Each of the bores 18 of the base 11 preferably has a plug 19 inserted therein from the top face 12 of the base 11 to substantially cover and close the bores 18 so that the bores 18 are not easily visible when the base 11 is mounted on the headstone 38. Optionally, fasteners such as brackets and anchors may be provided for mounting the base 11 to the headstone 38. As another option, an adhesive may be provided for adhesively coupling the bottom face 13 of the base 11 to a headstone 38, especially when the top 39 of the headstone 38 is generally smooth.

A pair of candle assemblies 20,21 are upwardly extended from the top face 12 of the base 11. One of the candle assemblies 20 is positioned towards one end edge 14 of the base 11, the other candle assembly 21 is positioned towards another end edge 15 of the base 11. The candle assemblies 20,21 are preferably generally located at a midpoint between the side edges 16,17 of the base 11. Each of the candle assemblies 20,21 has an outer configuration designed to resemble a candle. Each of the candle assemblies 20,21 has a generally cylindrical shaft having opposite root and tip ends and a longitudinal axis extending between the root and tip ends. The longitudinal axes of the candle assemblies 20,21 preferably extend generally perpendicular to the top face 12 of the base 11. The root end of each candle assembly is coupled to the top face 12 of the base 11 so that the tip ends upwardly extend from the top face 12 of the base 11. The root end of each of the candle assemblies 20,21 preferably has a tiered portion comprising a pair of concentric disk-shaped tiers 22,23. Each of the tiers 22,23 has a height extending upwardly from top face 12 of the base 11. Ideally, the heights of the tiers 22,23 are about equal to one another for providing a stable bottom to the candle assemblies 20,21.

Each of the candle assemblies 20,21 also has a light source 24 upwardly extending from the associated tip end. Ideally, each light source 24 comprises a light bulb or an LED. Each of the light sources 24 has an outer configuration designed to simulate a flame of a candle.

A power source assembly 25 for powering the light sources 24 is mounted to the top face 12 of the base 11. The power source assembly 25 has a housing 26 coupled to the top face 12 of the base 11. The housing 26 has a generally rectangular outer configuration with a generally planar upper face 27. The upper face 27 of the housing 26 preferably lies in a plane generally parallel to the plane of the top face 12 of the base 11. The housing 26 has a battery power source 28 (such as a pair of rechargeable batteries) provided therein. The battery power source 28 of the housing 26 is electrically connected to the light sources 24 for providing electrical power to energize the light sources 24 to provide illumination.

The upper face 27 of the housing 26 has a generally cylindrical cavity 30 therein. The cavity 30 of the housing 26 has a bottom wall 31 and a perimeter side wall 32 extending around the bottom wall 31 of the cavity 30. A disk-shaped member 33 is provided in the cavity 30. The disk-shaped member 33 has generally flat and circular top and bottom surfaces 34,35 and a perimeter wall 36. The disk-shaped member 33 is pivotally mounted in the cavity 30 of the housing 26. The top surface 34 of the disk shaped member has a plurality of photo-voltaic cells 37 thereon for converting sunlight into electrically energy. The photo-voltaic cells 37 are electrically connected to the battery power source 28 for recharging the battery power source 28 with the energy converted from the sun. The top surface 34 of the housing also preferably has a photo sensitive switch 29 electrically connected to the light sources 24. In use, the photo sensitive switch 29 activates the light sources 24 when the ambient light level goes below a predetermined level (that is, it gets sufficiently dark outside to activate the light sources 24).

The perimeter wall 36 of the disk shaped member abuts the perimeter side wall 32 of the cavity 30. The perimeter side wall 32 of the cavity 30 and the perimeter wall 36 of the disk-shaped member 33 has have complementary arcuate transverse cross sections such that the disk-shaped member 33 may be pivoted in the cavity 30 to direct the photo-voltaic cells 37 towards the sun. Ideally, the arcuate transverse cross section of the perimeter side wall 32 of the cavity 30 has a concavity 30 facing radially inwards towards a center of the cavity 30 and the arcuate transverse cross section of the perimeter wall 36 of the disk-shaped member 33 has a concavity 30 facing radially outwards from the center of the cavity 30. A pair of set screws 48 are extended through the housing and abuts the perimeter side of the disk-shaped member to hold it in place at the desired angle.

The headstone 38 has a top 39 and a front 40 and a pair of sides. The base 11 is mounted on the top 39 of the headstone 38. The headstone 38 preferably has at least one video image playing device for playing video images such as of the deceased. Each the video image playing device has a video display monitor 42 such as an LCD video monitor for displaying the video images mounted to the front 40 of the headstone 38. The video image playing device also has a plurality of controls 43 for controlling the video image playing device mounted to the front 40 of the headstone 38 adjacent the video display monitor 42.

The headstone 38 preferably has shutter 44 pivotally coupled thereto and substantially covering the video display monitor 42 and the controls 43 of the video playing device. The shutter 44 ideally comprises a metal material for providing durability and resistance to weathering. The video display monitor 42 and the controls 43 of the video playing device are preferably located in a generally rectangular depression 45 in the front 40 of the headstone 38. The shutter 44 substantially covers the depression 45 of the front 40 of the headstone 38. Preferably, the depression 45 has a thumb notch 46 for aiding lifting of the shutter 44.

Optionally, the headstone 38 may have a windup generator provided therein for providing electrically power to the video playing device. The windup generator has a rotatable winding crank 47 for powering the windup generator outwardly extending from one of the sides of the headstone 38.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A memorial light assembly, comprising:

a base;

said base being adapted for mounting on a headstone;

a pair of candle assemblies being upwardly extended from said base;

each of said candle assemblies having a light source, each of said light sources having an outer configuration adapted to simulate a flame of a candle;

a power source assembly being mounted to said base, said power source assembly being electrically connected to said light sources;

wherein said power source assembly has a housing coupled to said top face of said base, said housing having an upper face, said housing having a battery power source provided therein, said battery power source of said housing being electrically connected to said light sources; and wherein said upper face of said housing has a generally cylindrical cavity therein, wherein a disk-shaped member is provided in said cavity, said disk-shaped member being pivotally mounted in said cavity of said housing.

2. The memorial light assembly of claim 1, wherein said disk-shaped member has a top surface having a plurality of photo-voltaic cells thereon, said photo-voltaic cells being electrically connected to said battery power source.

3. The memorial light assembly of claim 1, wherein said cavity of said housing has a perimeter side wall, wherein disk-shaped member has a perimeter wall, said perimeter wall of said disk shaped member abutting said perimeter side wall of said cavity, said perimeter side wall of said cavity and said perimeter wall of said disk-shaped member having complementary arcuate transverse cross sections such that said disk-shaped member may be pivoted in said cavity.

4. The memorial light assembly of claim 1, further comprising a headstone, said base being mounted on said top of said headstone.

5. The memorial light assembly of claim 4, wherein said headstone has at least one video image playing device for playing video images, said video image playing device having a video display monitor for displaying the video images mounted to said headstone, said video image playing device having a plurality of controls for controlling said video image playing device mounted to said headstone adjacent said video display monitor.

6. The memorial light assembly of claim 5, wherein said headstone has shutter pivotally coupled thereto and substantially covering said video display monitor and said controls of said video playing device.

7. The memorial light assembly of claim 6, wherein said video display monitor and said controls of said video playing device are located in a generally rectangular depression in said headstone, said shutter substantially covering said depression of said headstone.

8. The memorial light assembly of claim 5, wherein said headstone has a windup generator provided therein for providing electrically power to said video playing device, wherein said windup generator has a rotatable winding crank for powering said windup generator outwardly extending from said headstone.

9. A memorial light assembly, comprising:

a base being generally rectangular in configuration and having generally planar top and bottom faces, a pair of generally straight end edges, and a pair of generally straight side edges extending between said end edges of said base;

said top and bottom faces of said base lying in generally parallel planes to one another, said end edges of said base extending generally parallel to one another, said side edges of said base extending generally parallel to one another and generally perpendicular to said end edges, said end edges and said side edges of said base lying in generally perpendicular planes to said top and bottom faces of said base;

said base being mounted on a headstone;

said base having a plurality of bores extending therethrough between said top and bottom faces of said base, each of said bores being having a fastener extending therethrough to fasten said base to the headstone;

each of said bores of said base having a plug inserted therein from said top face of said base to substantially close said bores;

a pair of candle assemblies being upwardly extended from said top face of said base, one of said candle assemblies being positioned towards one end edge of said base, another of said candle assemblies being positioned towards another end edge of said base, said candle assemblies being generally located at a midpoint between said side edges of said base;

each of said candle assemblies having a generally cylindrical shaft having opposite root and a tip ends and a longitudinal axis extending between said root and tip ends, said longitudinal axes of said candle assemblies extending generally perpendicular to said top face of said base;

said root end of each candle assembly being coupled to said top face of said base;

said root end of each of said candle assemblies having a tiered portion comprising a pair of concentric disk-shaped tiers, each of said tiers having a height extending upwardly from top face of said base, wherein said heights of said tiers are about equal to one another;

each of said candle assemblies having a light source upwardly extending from the associated tip end, each of said light sources having an outer configuration adapted to simulate a flame of a candle;

a power source assembly being mounted to said top face of said base;

said power source assembly having a housing coupled to said top face of said base, said housing having a generally rectangular outer configuration, said housing having a generally planar upper face, said upper face of said housing lying in a plane generally parallel to said plane of said top face of said base;

said housing having a battery power source provided therein, said battery power source of said housing being electrically connected to said light sources;

an arcuate transverse cross section of a perimeter side wall of a cavity having a concavity facing radially inwards towards a center of said cavity, wherein said arcuate transverse cross section of said perimeter wall of said disk-shaped member has a concavity facing radially outwards from said center of said cavity;

said headstone having a top and a front and a pair of sides;

said headstone having at least one video image playing device for playing video images, said video image playing device having a video display monitor for displaying the video images mounted to said front of said headstone, said video image playing device having a plurality of controls for controlling said video image playing device mounted to said front of said headstone adjacent said video display monitor;

said headstone having shutter pivotally coupled thereto and substantially covering said video display monitor and said controls of said video playing device; and said video display monitor and said controls of said video playing device being located in a generally rectangular depression in said front of said headstone, said shutter substantially covering said depression of said front of said headstone.

10. A memorial light assembly, comprising:

a base;

said base being adapted for mounting on a headstone;

a pair of candle assemblies being upwardly extended from said base;

each of said candle assemblies having a light source, each of said light sources having an outer configuration adapted to simulate a flame of a candle;

a power source assembly being mounted to said base, said power source assembly being electrically connected to said light sources; and a headstone, said base being mounted on said top of said headstone.

11. The memorial light assembly of claim 10, wherein said headstone has at least one video image playing device for playing video images, said video image playing device having a video display monitor for displaying the video images mounted to said headstone, said video image playing device having a plurality of controls for controlling said video image playing device mounted to said headstone adjacent said video display monitor.

12. The memorial light assembly of claim 11, wherein said headstone has shutter pivotally coupled thereto and substantially covering said video display monitor and said controls of said video playing device.

13. The memorial light assembly of claim 12, wherein said video display monitor and said controls of said video playing device are located in a generally rectangular depression in said headstone, said shutter substantially covering said depression of said headstone.

14. The memorial light assembly of claim 11, wherein said headstone has a windup generator provided therein for providing electrically power to said video playing device, wherein said windup generator has a rotatable winding crank for powering said windup generator outwardly extending from said headstone.

* * * * *